US006093046A

United States Patent [19]

Chiou et al.

[11] Patent Number: 6,093,046

[45] Date of Patent: Jul. 25, 2000

[54] ELECTRICAL CONNECTOR

[75] Inventors: Song-Rong Chiou, Lin-Kou; Kun-Tsan Ku, Tu-Chen, both of Taiwan

[73] Assignee: Hon Hai Precision Ind. Co., Ltd., Taipei Hsien, Taiwan

[21] Appl. No.: 09/360,598

[22] Filed: Jul. 26, 1999

[30] Foreign Application Priority Data

Dec. 18, 1998 [TW] Taiwan ..... 87221144

[51] Int. Cl.[7] ..... H01R 13/64

[52] U.S. Cl. ..... 439/378; 439/608

[58] Field of Search ..... 439/378, 607, 439/609, 608

[56] References Cited

U.S. PATENT DOCUMENTS 5,356,300 10/1994 Costello et al. ..... 439/378
5,474,472 12/1995 Niwa et al. ..... 439/608
5,535,100 7/1996 Lubahn et al. ..... 439/378
5,919,063 7/1999 Wang ..... 439/607

*Primary Examiner*—Gary F. Paumen
*Attorney, Agent, or Firm*—Wei Te Chung

[57] ABSTRACT

An electrical connector comprises an insulative housing, a shield, a number of terminals, a shielding blade and a pair of guide posts. The housing includes a cover and a base separately manufactured by injection molding. Thus, a height of a corresponding mold for forming the cover and the base is decreased thereby promoting the free flow of molten plastic and enhancing the strength of the housing especially terminal passageways thereof. In assembly, the shield, the cover and the base are secured together by riveting the guide posts. The blade is disposed in the cover and the base for eliminating cross talk between the terminals. The blade electrically contacts the shield which is conductively connected to the guide posts.

5 Claims, 4 Drawing Sheets

ELECTRICAL CONNECTOR

BACKGROUND OF THE INVENTION

The present invention generally relates to an electrical connector, and particularly to an electrical connector having a strengthened insulative housing for receiving a high density of terminals.

Signal transmissions between electronic devices, such as computers, becomes increasingly frequent and only connectors with high density terminals can meet this requirement. However, the more terminals an insulative housing retains, the more stress the housing must sustain. Thus, inner wall of terminal passageway is likely to become damaged when the terminal is inserted therein. The insulative housing of the connector is usually made through injection molding process to form a unitary member. When the height of the connector increases, an enlarged mold for the housing is required. However, such mold commonly impedes the free flow of molten plastic thereby adversely affecting the strength of passageways thereby imposing a certain limit to the pitch of terminals received in the passageways.

Furthermore, the high density of terminals of the connector and the large amount of information transmitted therethrough require that the connector must have excellent shielding capabilities against exterior interference noises and interior cross talk between the terminals. However, conventional connectors cannot satisfy the above-mentioned conditions. Therefore, a connector directed toward eliminating these problems is required.

SUMMARY OF THE INVENTION

Accordingly, the primary purpose of the present invention is to provide an electrical connector having an insulative housing of an enhanced strength for receiving a high density of terminals.

The second purpose of the invention is to provide an electrical connector which effectively eliminates exterior interference signals and cross talk between terminals.

To fulfill the above-mentioned objects, an electrical connector comprises an insulative housing, a shield, a plurality of terminals and a pair of guide posts. The housing includes a cover and a base separately manufactured by injection molding. Thus, a height of a corresponding mold for forming the cover and the base is decreased thereby promoting the free flow of molten plastic and enhancing the strength of the housing, especially the terminal passageways thereof. In assembly, the shield, the cover and the base are secured together by riveting the guide posts.

In accordance with another aspect of the present invention, the connector further comprises a shielding blade disposed in the base and the cover for eliminating cross talk between the terminals. The blade electrically contacts the shield which is conductively connected to the guide posts. When the connector mates with a second connector, the posts contact grounding portions of the second connector before the terminals of the connectors contact. Therefore, electrical charges accumulated on the shield and the blade are effectively drained out.

DETAILED DESCRIPTION OF THE PREFERRED EMBODIMENT

Figure 1:
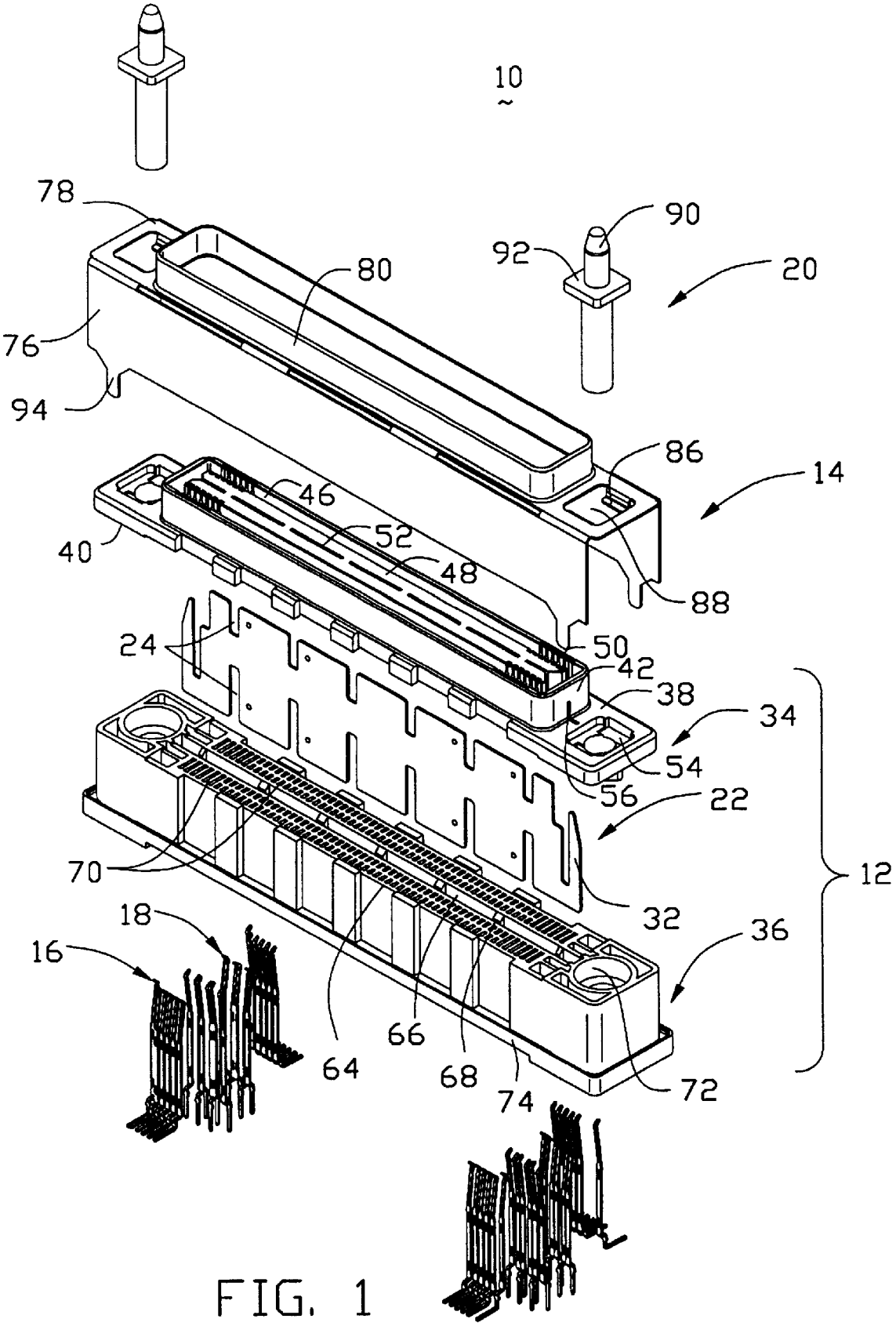
FIG. 1 is an exploded view of an electrical connector in accordance with the present invention.

Referring to FIG. 1, an electrical connector 10 in accordance with the present invention comprises an insulative housing 12, a shield 14, a plurality of terminals, a pair of guide posts 20 and an elongate shielding blade 22. The blade 22 forms a plurality of cutouts 24 in opposite edges thereof and a pair of spring arms 32 at opposite ends thereof.

The housing 12 with a height such as 16 mm includes a cover 34 and a base 36. The cover 34 has a mating face 38 and a first mounting face 40 opposite the mating face 38. An elongate mating portion 42 projects upward from the mating face 38 and forms a receiving slot 46 in a central portion thereof. An elongate projection 48 projects from a bottom of the slot 46 and forms several slits 52 therein. Four rows of terminal passageways 50 are formed on opposite surfaces of the projection 42 and inner surfaces of the slot 46 facing the surfaces of the projection 48. The passageways 50 are defined through the mating face 38 and the first mounting face 40 for receiving the terminals. A pair of mounting holes 54 is formed in the mounting face 38 of the cover 34 proximate opposite ends thereof. An aperture 56 is defined in each end of the mating portion 42 and the mating face 38 proximate the mounting hole 54.

Figure 3:
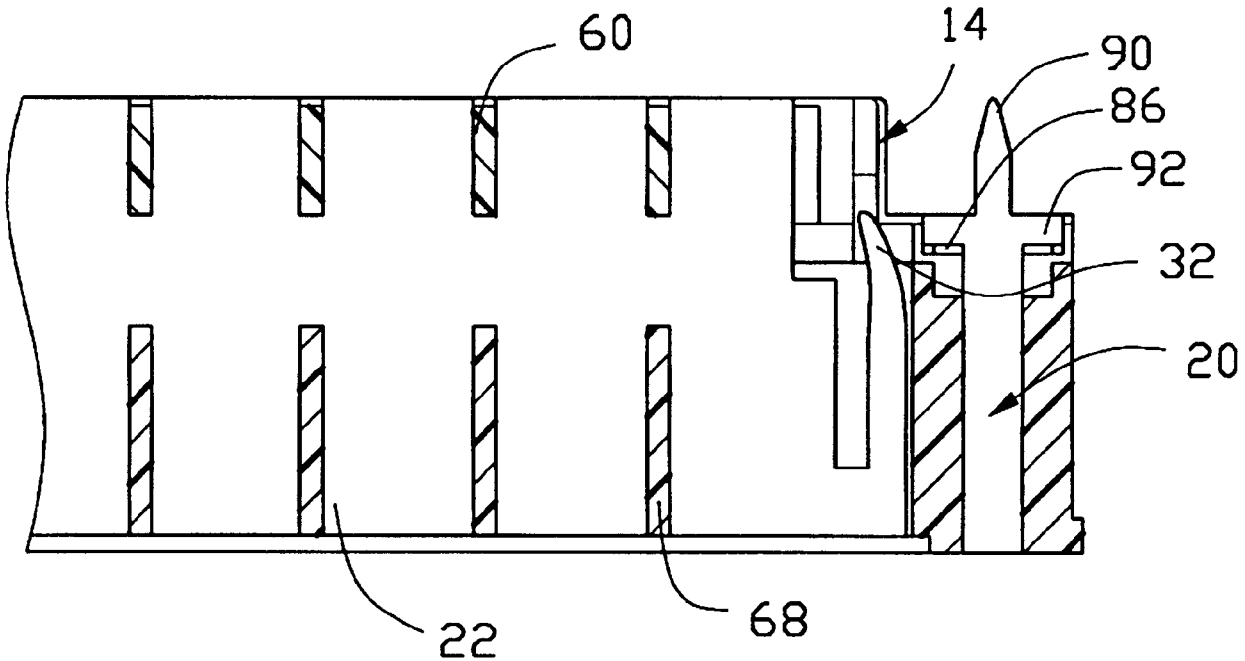
FIG. 3 is a partial, cross-sectional view taken along line 3—3 of FIG. 2.

Also referring to FIG. 3, a stop portion 60 is disposed between each pair of adjacent slits 52 and adapted to correspond with the cutouts 24 defined in an upper edge of the blade 22. The upper edge of the blade 22 extends into the slits 52 for contacting a grounding portion of a mating connector (not shown). In addition, the two spring arms 32 are received in the apertures 56 of the mating portion 42.

Figure 4:
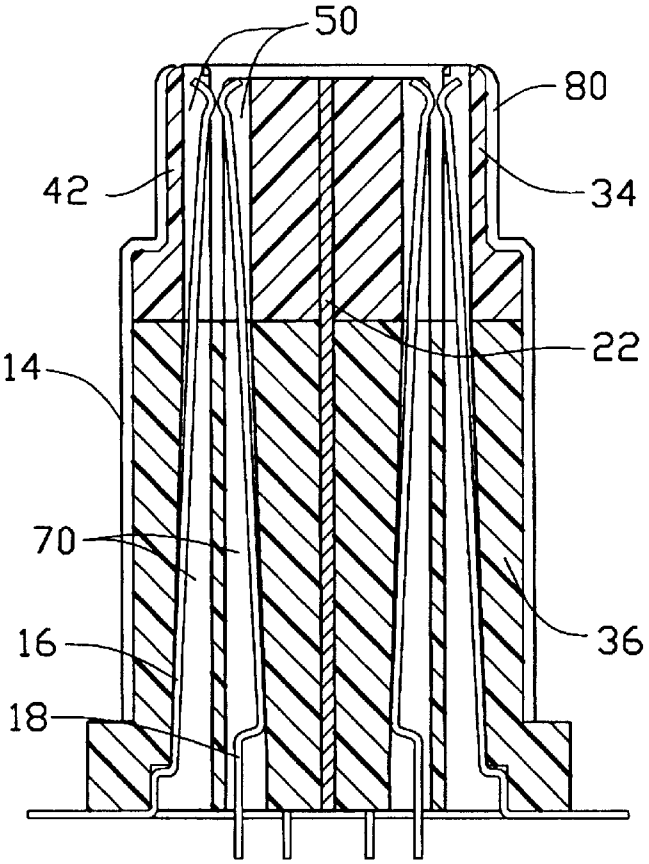
FIG. 4 is a cross-sectional view taken along line 4—4 of FIG. 2.

Referring to FIGS. 1 and 4, the base 36 of the housing 12 includes a second mounting face 64 for contacting the first mounting face 40 and forms a slot 66 in a central portion thereof for receiving a lower portion of the blade 22. The slot 66 has a plurality of stop portions 68 formed therein for engaging with the cutouts 24 defined in a lower edge of the blade 22. Four rows of terminal passageways 70 are defined through the base 36 along the sides thereof in alignment with the passageways 50 of the cover 34.

The terminals include first terminals 18 and second terminals 16. The first terminals 18 are received in inner rows of the passageways 50, 70 to be soldered to a circuit board (not shown) using Through Hole Technology. The second terminals 16 are received in outer rows of the passageways 50, 70 to be soldered to the circuit board using Surface Mounting Technology. The terminals are arranged in the housing with a high density, such as two hundred and forty terminals are arranged with a pitch as 0.8. A pair of mounting openings 72 is formed in the opposite ends of the base 36 in alignment with the mounting holes 54 of the cover 34. The base 36 includes a flange 74 along a bottom periphery thereof.

The shield 14 includes a planar section 78, a pair of side walls 76 substantially perpendicular to the planar section 78 and an integrally drawn shroud 80 extending upward from the planar section 78. Two tail portions 94 extend downward from an edge of each side wall 76. A pair of through holes 88 is formed in the planar section 78 in alignment with the mounting holes 54 of the cover 34 and the mounting openings 72 of the base 36. Retention hooks 86 extend from an edge of each through hole 88. The guide post 20 is cylindrical and has a tapered head 90 and a square support portion 92 proximate the head 90.

Figure 2:
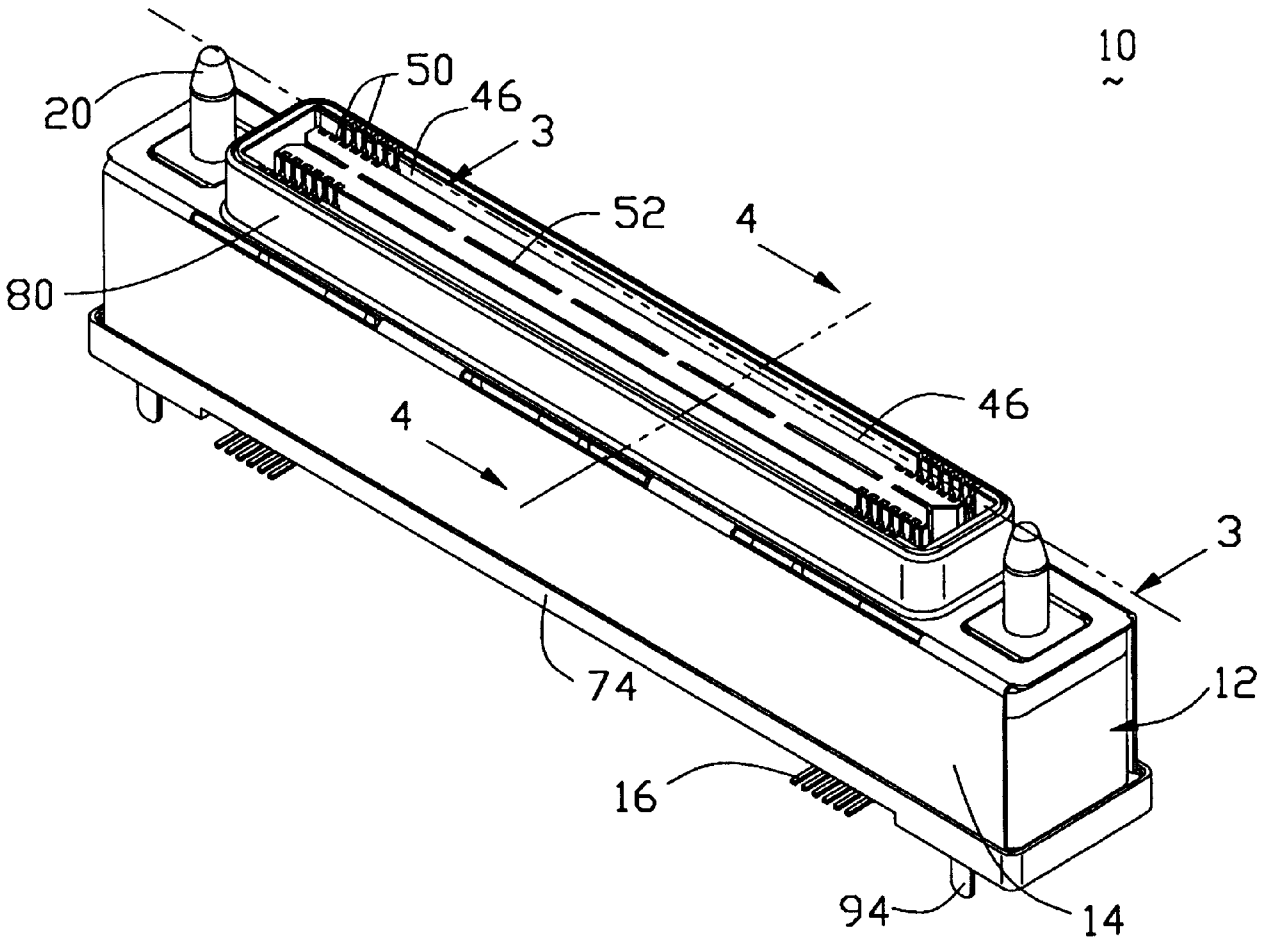
FIG. 2 is an assembled view of FIG. 1.

Referring to FIGS. 2 and 4, in assembly, the cover 34 and the base 36 are mounted together and the blade 22 is disposed therein for eliminating cross talk between the terminals. The shield 14 is then attached to the housing 12. The shroud 80 surrounds the projection 42 of the cover 34. The side walls 76 contact longitudinal surfaces of the housing 12 and lower edges thereof are retained in the flange 74. The tail portions 94 of the shield 14 extend through the flange 74 to be soldered to a corresponding circuit of the circuit board (not shown) for grounding the shield 14. The guide post 20 extends through the corresponding the through hole 88 of the shield 14, the mounting hole 54 of the cover 34 and the mounting opening 72 of the base 36 to secure the shield 14, the cover 34 and the base 36 together after being riveted. The support portion 92 of the guide post 20 is retained by the retention hook 86 of the shield 14 and is electrically engaged therewith. The spring arms 32 of the blade 22 are received in the corresponding apertures 56 of the cover 34 and electrically contact the shield 14 (FIG. 3). Thus, the shield 14, the blade 22 and the guide post 20 are conductively connected to each other.

The cover 34 and the base 36 of the housing are separately manufactured by injection molding. Thus, a height of a corresponding mold for forming the cover 34 and the base 36 is decreased thereby promoting the free flow of molten plastic therein and enhancing the strength of the housing 12 especially of the terminal passageways 50, 70. It is readily apparent that the housing 12 can effectively retain a high density of terminals. When the electrical connector mates with a second connector, the guide posts 20 contact corresponding grounding portions of the second connector before the terminals contact corresponding contacts thereof. Thus, accumulated charges on the shield 14 and the blade 22 are effectively eliminated such that signal transmission through the terminals is not adversely affected by interference. Since the first and second terminals 18, 16 are respectively soldered to different surfaces of the circuit board by means of Through Hole Technology and Surface Mounting Technology, the pitch of the terminals mounted on the same surface is decreased which enhances the quality of a soldering process.

It is noted that a dividing wall 71 is positioned between the inner row passageways 70 and the adjacent outer row passageways 70 to separate the two corresponding terminals 16, 18, while the adjacent two passageways 50 are without the similar divider therebetween, so that a plate type portion of a mating connector (not shown) can be sandwiched between the two corresponding terminals 16, 18 in these two adjacent passageways 50.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim:

1. An electrical connector mounted on a circuit board, comprising:

an insulative housing including a cover and a base, each of the cover and the base defining a plurality of terminal passageways, the cover defining a mounting hole therethrough, the base defining a mounting opening therethrough aligned with the mounting hole, the base and the cover being separately injection molded and mounted together to form the housing;

a guide post extending through the mounting opening of the base and the mounting hole of the cover to bond the base and the cover; and a plurality of terminals retained in corresponding passageways of the base and the cover;

wherein a shielding blade is disposed in the housing for eliminating cross talk between the terminals;

further comprising a shield attached to the housing, and wherein a spring arm extends from a side edge of the blade for electrically contacting the shield;

wherein the guide post is conductively connected to the shield and the blade.

2. The electrical connector as claimed in claim 1, wherein an elongate mating portion projects upward from a top face of the cover and forms a receiving slot in a central portion thereof, and wherein an elongate projection projects from a bottom of the slot.

3. The electrical connector as claimed in claim 1 further comprising a shield attached to the housing.

4. The electrical connector as claimed in claim 1, wherein the blade includes cutouts for engaging the cover and the base, respectively.

5. An electrical connector mounted on a circuit board, comprising:

an insulative housing including a cover and a base aligned and stacked with each other, the base defining a slot in a central portion, the cover defining an elongated projection with a plurality of slits therein, a first stop portion being positioned between every two adjacent slits, said slits being aligned with the slot in a vertical direction;

a grounding blade defining an upper portion received within the slits, and a lower portion received within the slot, said upper portion defining a plurality of first cutouts, and said lower portion defining a plurality of second cutouts;

plurality of second stop portions formed in the slot of the base and received within the corresponding second cutouts; and said first stop portion of the cover received within the corresponding first cutout;

wherein said blade further includes a spring arm at one end thereof, and the cover defines an aperture adjacent one end thereof so that the spring arm extends through said aperture to engage a shield enclosing said cover.

* * * * *